US005692408A

United States Patent [19]

Alitalo

[11] Patent Number: 5,692,408

[45] Date of Patent: Dec. 2, 1997

[54] FOLDING PRESS

[75] Inventor: Hannu Alitalo, Urjala, Finland

[73] Assignee: Aliko Automation Oy, Urjala, Finland

[21] Appl. No.: 617,878

[22] PCT Filed: Sep. 16, 1994

[86] PCT No.: PCT/FI94/00409

§ 371 Date: May 28, 1996

§ 102(e) Date: May 28, 1996

[87] PCT Pub. No.: WO95/07778

PCT Pub. Date: Mar. 23, 1995

[30] Foreign Application Priority Data

Sep. 16, 1993 [FI] Finland ..... 934069

[51] Int. Cl.$^6$ ..... B21D 5/02; B21D 43/10

[52] U.S. Cl. ..... 72/306; 72/389.3; 72/404; 72/420

[58] Field of Search ..... 72/389.3, 389.6, 72/306, 472, 442, 420, 422, 404

[56] References Cited

U.S. PATENT DOCUMENTS

| | | | |
|---|---|---|---|
| 4,327,570 | 5/1982 | Schottker | 72/306 |
| 4,391,119 | 7/1983 | Schmitz | 72/389.3 |
| 4,510,785 | 4/1985 | Triouleyre | 72/323 |
| 5,099,670 | 3/1992 | Sartorio | 72/311 |
| 5,291,771 | 3/1994 | Tomo | 72/306 |

FOREIGN PATENT DOCUMENTS

| | | | |
|---|---|---|---|
| 3006325 | 8/1981 | Germany | 72/404 |
| 28039 | 2/1987 | Japan | 72/404 |
| 27487 | of 1906 | United Kingdom | 72/404 |

*Primary Examiner*—Daniel C. Crane

*Attorney, Agent, or Firm*—Mathews, Collins, Shepherd & Gould

[57] ABSTRACT

A folding press, comprising at least two fixed beams: a first fixed beam ($2^1$) and a second fixed beam ($2^2$), to which are connected counterblades ($5^1$, $5^2$), and a ram beam (3) being disposed between these first fixed beam ($2^1$) and second fixed beam ($2^2$), and to the ram beam (3) being connected two thrust blades ($6^1$, $6^2$) on both parallel margins of the ram beam, whereby the counterblades and thrust blades constitute a first pair of folding blades ($5^1$, $6^1$) and a second pair of folding blades ($5^2$, $6^2$) while the ram beam (3) serves as joint ram for both pairs of folding blades. A force member (4) has been arranged to produce bidirectional working stroke of the ram beam (3) optionally toward the first or second fixed beam. A manipulation arm (7) is arranged to serve the first as well as the second pair of folding blades.

11 Claims, 3 Drawing Sheets

FOLDING PRESS

Figure 1:
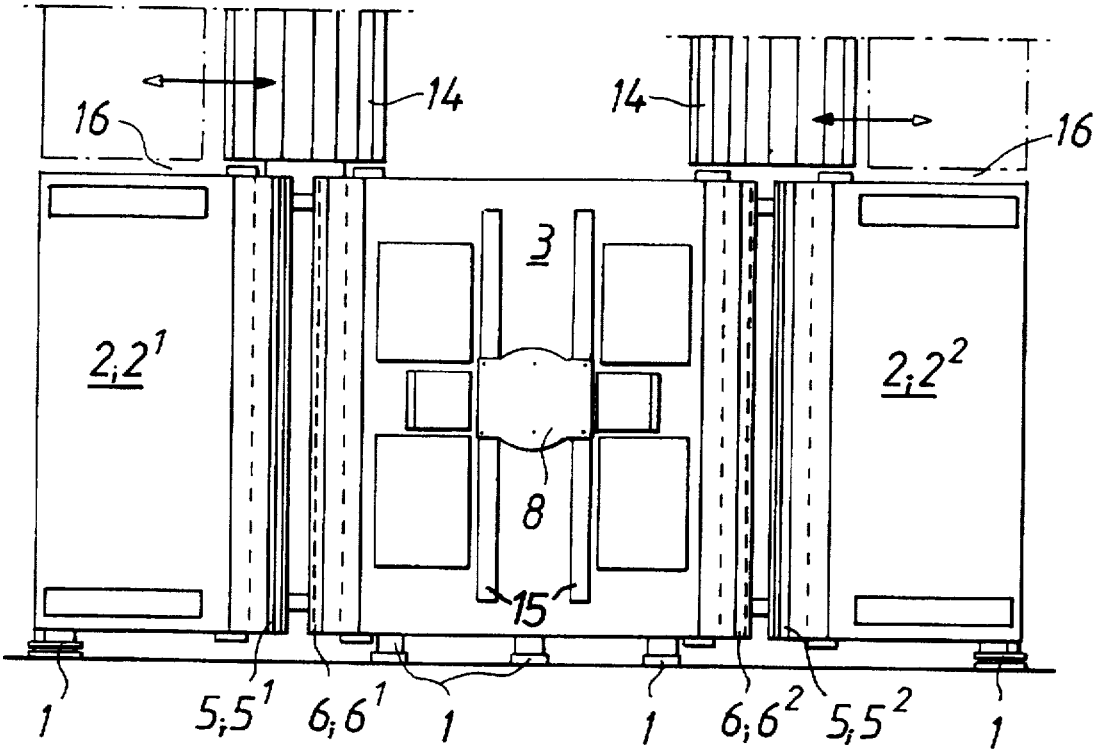

This application is a 371 of PCT/FI94/00409, filed Sep. 16, 1994.

The present invention concerns a folding press.

In prior arc a folding press As known comprising a frame fixedly supported on the base; a fixed beam, which is fixedly connected to the frame; a ram beam, supported by the frame to be movable relative to the fixed beam; a force member, disposed between the ram beam and the frame for moving the ram beam relative to the fixed beam in order to accomplish the folding work movement; a counterblade, attached to the fixed beam; a thrust blade, attached to the ram beam parallelly in relation to the counterblade, the counterblade and thrust blade constituting a pair of folding blades between which a piece of metal sheet can be folded; a many-hinged manipulation arm for clamping and handling the place which is to be folded, and for inserting it between the folding blades in a pre-determined manner. In the folding press of prior art the working stroke of the ram beam is usually vertical, whereby the throat between the blades is horizontal. Moreover, typically, a folding press of this type has only one pair of folding blades, folding of the piece of sheet being performed in the gap thereof by handling the piece of sheet by means of a manipulation arm feeding it in between the folding blades.

The problem which the folding press of prior art is that only folds of quite restricted kind can therewith be produced in the piece of sheet with one single clamping, owing to the single thruster/counter-piece pair feature. If one desires further foldings of another kind in the workplace, the manipulation arm must release the piece from its grip and the piece has to be moved to be further folded on another folding press; this implies that the setting of the piece of sheet on the manipulation arm has to be redefined. this is cumbersome and time-consuming. Another problem is that when the metal sheet is gripped by the clamping member of the manipulation arm and transported in horizontal attitude into the folding gap, the sheet will bend downward, giving rise to folding errors. Bending of the sheet during the manipulation step is also problematic for the reason that when programming of the operation is accomplished by means of computer-aided simulation, calculation of the sheet's bending is extremely difficult because air resistances etc. have to be taken into account.

The object of the invention is to eliminate the drawbacks mentioned.

Specifically the object of the invention is to disclose a folding press of completely novel type, which enables the building up of a versatile folding press line as simply as possible and with few components.

The object of the invention is further to disclose a folding press enabling with a single fixing of the sheet to the manipulation arm, folding of the sheet with two pairs of folding blades.

Further still, the object of the invention is to disclose a folding press enabling metal sheets to be folded without incurring substantially any bending of the sheets when they are being handled with the manipulation arm.

The folding press of the invention comprises a frame; a fixed beam, fixedly connected to the frame; a ram beam, supported by the frame to be movable relative to the fixed beam; a force member, disposed between the ram beam and the frame for moving the ram beam relative to the fixed beam in order to accomplish the folding working stroke; an elongated and beam-like counterblade, attached to the fixed beam; in elongated and beam-like thrust blade, attached to the ram beam parallel relative to the counterblade, the counterblade and thrust blade together forming a folding throat, or a pair of folding blades, the piece of metal sheet being foldable therebetween; and a many-hinged manipulation arm for clamping the piece to be folded and inserting it between the pair of folding blades in predetermined manner.

As taught by the invention, the folding press comprises at least two fixed beams, a first fixed beam and a second fixed beam, to which counterblades are connected, and the ram beam being disposed between these first and second fixed beams and to the ram beam being connected two thrust blades on both parallel margins of the ram beam, whereby the counterblades and thrust blades define a first pair of folding blades and a second pair of folding blades, the ram beam serving as joint ram to both pairs of folding blades. A force member is arranged to produce bidirectional working stroke of the ram beam, optionally towards the first or second fixed beam. The manipulation arm is disposed to serve both the first and the second pair of folding blades.

The invention affords the advantage that it enables a versatile folding press line in the simplest possible way and with few components.

The invention affords the advantage that after the piece to be folded has been grasped with the manipulation arm the piece of sheet material can first be folded with the first pair of folding blades by placing it with the aid of the manipulation am between the blades in desired positions, while holding the piece firmly all the time, whereafter the folding operation can be continued by transporting the piece of sheet material with the manipulation arm into the gap of the second pair of folding blades, which is different from the first pair of folding blades, and the folding operation can be continued with different blades without need to release the hold of the manipulation arm on the piece. This is conducive to remarkably faster folding. It is possible with a so-called tandem folding press according to the invention, even in its simplest form, to achieve the capacity of at least two folding presses while the initial and operating and service costs of the folding press are quite much lower. The bi-directional motion of the ram bee can be achieved with a single force member, e.g., a hydraulic cylinder, and this further notably simplifies the construction. It is equally possible to provide several force members, as may be required.

In an advantageous embodiment of the folding press, the counterblades and thrust blades are substantially vertical, the thrust blades being disposed on both parallel margins of the ram beam and the counterblades being accordingly disposed on the vertical margins of the fixed beams, whereby the blades will define a first pair of folding blades and a second pair of folding blades, both substantially vertical. The ram beam is guided to move substantially horizontally, and the force member is arranged to cause a horizontal working stroke of the ram beam. By arranging the fixed and ram beams and the blades to be substantially vertical so that the folding throats are vertically oriented, the significant advantage is gained that the metal sheet can be handled in vertical attitude, with the consequence that it keeps perfectly straight and will not bend, which could happen if the sheet were handled in horizontal position. As the folding throats are vertical, horizontal working stroke of the ram beam is naturally achieved, whereby one obtains a maximally compact construction with minimal space requirements. At the same time, horizontal material flow of the work pieces is advantageously achieved.

In an advantageous embodiment of the folding press to the manipulation arm belongs a stand, relative to which the manipulation arm has been carried to be rotatable, and the stand is affixed to the ram beam, advantageously at the centre of the ram beam. One achieves by locating the manipulation arm, e.g. a piece handling robot, in conjunction with the ram beam that as the robot travels along with the ram beam its motion is exactly in the right direction because as the is being folded the clamping member of the robot moves away from the robot all the time. The ram beam is a firm fixing base for the robot, and the accuracy of its positioning relative to the blades is well retained. It is a further advantage that a centrally placed robot has the best chances to handle the piece of sheet material just between and at the center of both fixed beams. It is also an advantage that free floor space is left where blanks going to be folded can be kept.

In an advantageous embodiment of the press the stand of the robot can be provided with guides which are parallel to the blades and on support and in guidance of which the robot can be displaced. The travel length of the path can be nearly equal the length of the blades, whereby additional reach of the robot is gained. This is a particular advantage if the blade length is remarkable, e.g. 3 to 4 m.

In an advantageous embodiment of the folding press the manipulation arm is an industrial robot, comprising a robot arm, supported on a stand, with a number of arms one after the other and hinged to each other and, on the outer end of this arm system, a clamping member for grasping the piece of sheet material. Said industrial robot may be a standard industrial robot, which commands a favourable price owing to it being manufactured in great numbers. The robot may equally be e.g. a robot provided with a so-called serpentine robot arm.

In an advantageous embodiment of the folding press the folding press comprises a tool storage for ram blades and counterblades. This tool storage is disposed within reach of the manipulation arm so that the ram blades and counterblades can be changed with the aid of the manipulation arm.

In an advantageous embodiment of the folding press the tool storage is a tool magazine, advantageously a revolving tool magazine, which has been placed on top of the folding press and in which the thrust blades and counterblades are kept in positions substantially parallel to their working position which they have when mounted on the fixed and ram beams.

In an advantageous embodiment of the folding press the folding press comprises a plurality of ram beams which have been disposed alternatingly between pairs of fixed beams and in line with these. The folding press comprises a plurality of manipulation arms, each one of them arranged to serve two pairs of folding blades and to forward the pieces being folded from one manipulation arm to the other. When the robots give pieces one to the other, they may on software level go through a so-called handshake procedure, i.e., if one robot grasps the piece on the other side and the other robot releases its grasp the position data of the piece is preserved all the time.

In an advantageous embodiment of the folding press the number of manipulation arms is equivalent to the number of ram beams.

In an advantageous embodiment of the folding press the folding press is disposed in substantially horizontal position, the ram beam and fixed beams with their folding blades substantially in a horizontal plane, whereby the piece of sheet material to be folded can be introduced between the pair of folding blades in substantially vertical position. The folding press may be disposed in horizontal position up at the ceiling or on absolute floor level. The main thing is that the piece of sheet material does not bend nor wobble since it can be handled in vertical position. When a larger sheet with dimensions on the order of e.g. 50×3000×14000 mm is being folded, the folding press may be disposed horizontally on floor level, in which case also the height of the shop hall in which the folding press has been mounted need not be exceedingly high: a hall having a height on the order of 4 to 5 m will suffice. If the folding press were mounted in vertical position as in the state of art, a hall with height on the order of 7 m an least would be required.

Figure 2:
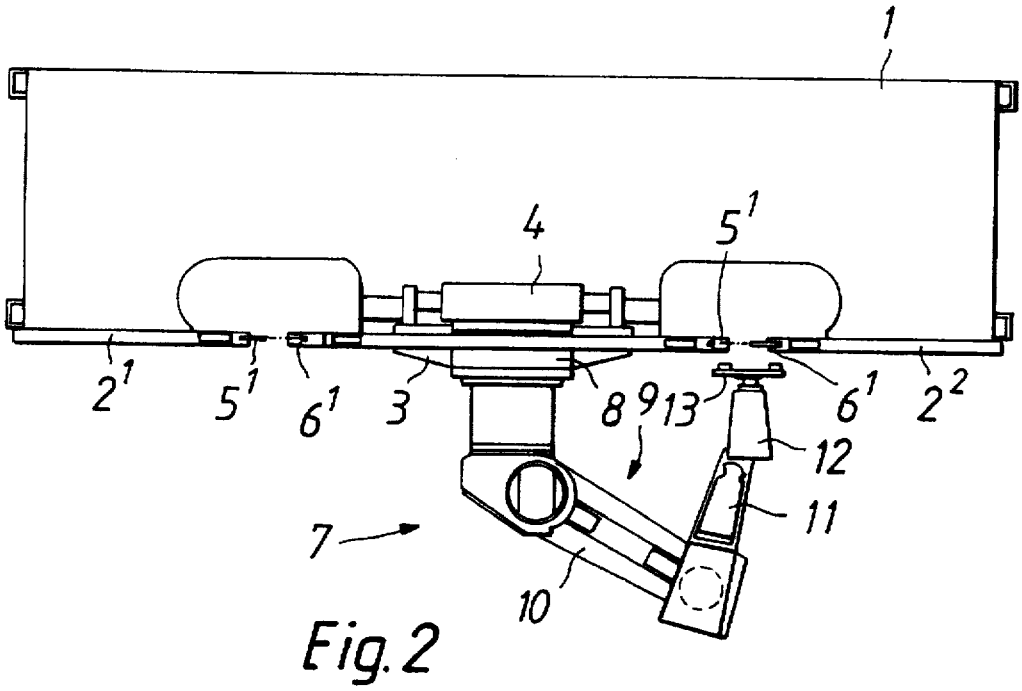
Figure 3:
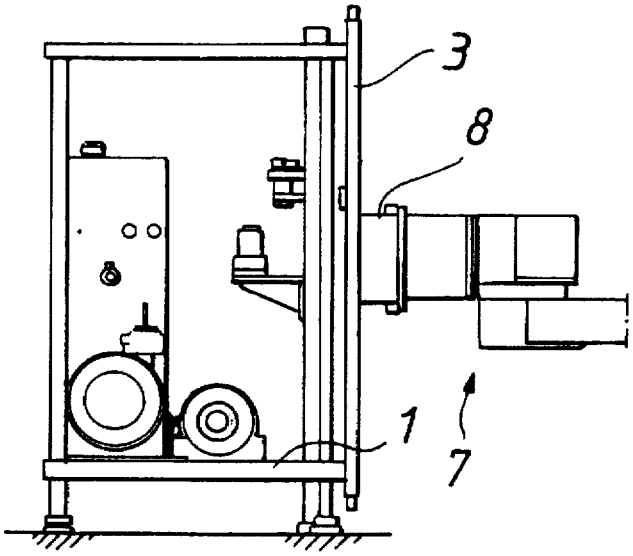
Figure 4:
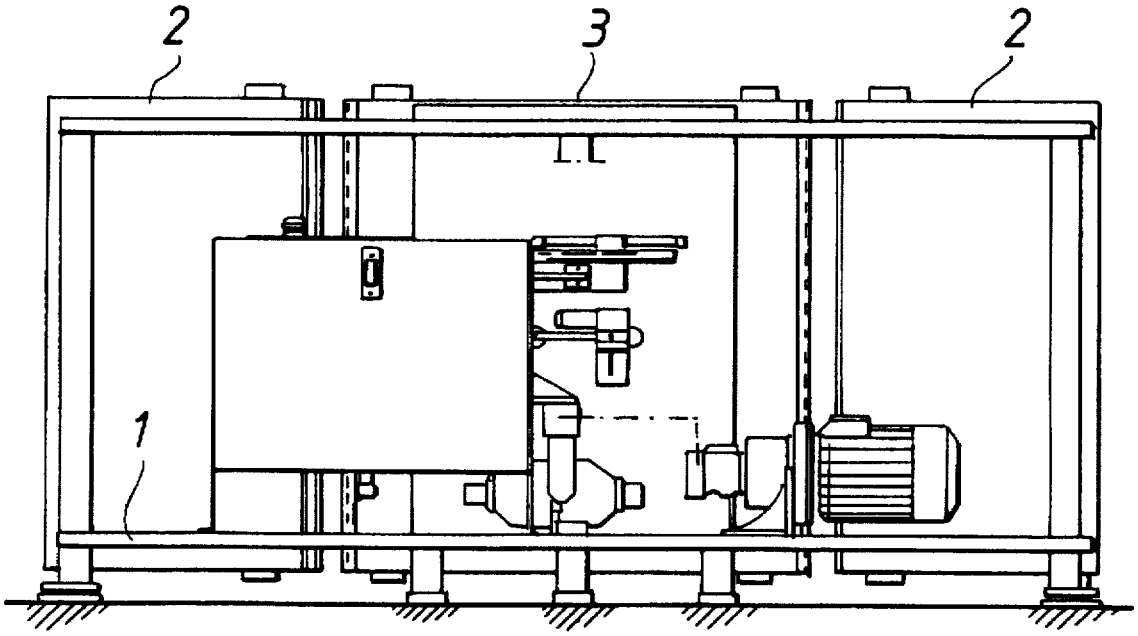

In the following the invention is described in detail, referring to the attached drawing, wherein, FIG. 1 presents schematically and in front view an embodiment of the folding press of the invention;

FIG. 2 presents, viewed from above, the embodiment of FIG. 1;

FIG. 3 presents in elevational view the embodiment of FIG. 1;

FIG. 4 presents, viewed from the rear, the embodiment of FIG. 1; and

Figure 5:
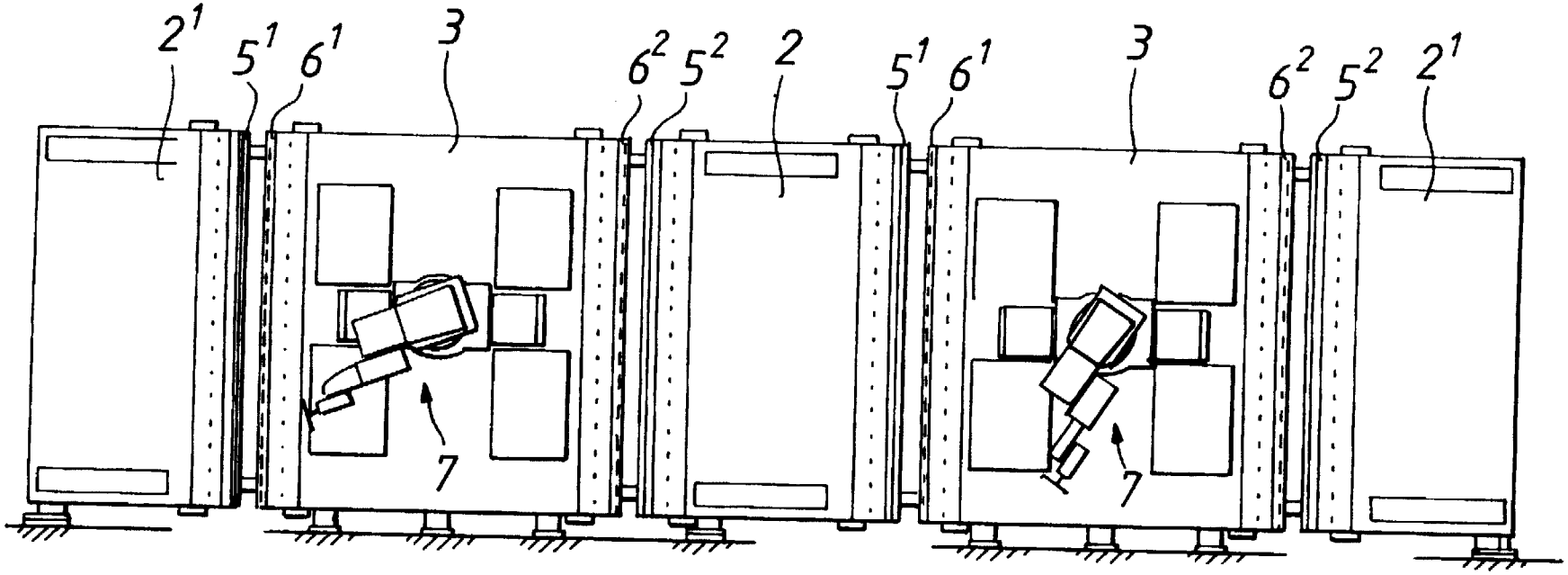

FIG. 5 presents schematically and in front view another embodiment of the folding press of the invention.

FIGS. 1–4 depict a folding press comprising a frame 1, which rests on a base. In this single frame 1 are assembled substantially all the parts and components of the folding press. The folding press comprises two fixed beams $2^1$,$2^2$, which are called the first fixed beam $2^1$ and the second fixed beam $2^2$. The fixed beams $2^1$ and $2^2$ are fixedly connected to the frame 1, in vertical position. Between these fixed beams, in one plane with them, has been disposed a movable ram beam 3, which is guided by the aid of guide members to be reciprocatingly movable relative to the frame 1 and to the fixed beams $2^1$,$2^2$.

The ram beam 3 is rectangular in shape and comprises two mutually parallel vertical sides. To these two vertical sides of the ram beam 3 are connected thrust blades $6^1$,$6^2$, which are elongated and beam-like. A similarly elongated and beam-like first counterblade $5^1$ is connected to that vertical side of the first fixed beam $2^1$ which faces the vertical side of the ram beam 3 and the first thrust blade $6^1$ thereto affixed. A likewise elongated and beam-like second counterblade $5^2$ is connected to that vertical side of the first fixed beam $2^1$ which faces the vertical side of the ram beam 3 and the second thrust blade $6^2$ thereto affixed. In this way two pairs of folding blades are defined, a first pair of folding blades $5^1$,$6^1$ and a second pair of folding blades $5^2$,$6^2$, the piece of sheet metal being foldable in the throats between them. Thus, the ram beam 3 serves as joint ram to both pairs of folding blades. The bidirectional horizontal working stroke of the ram beam 3, optionally toward the first or second fixed beam $2^1$; $2^2$, has been accomplished with a force member 4, such as a hydraulic cylinder, which is disposed to act between the ram beam 3 and the frame 1. The number of force members 4 may be selected in accordance with need in each instance, e.g. in accordance with the length of the ram bar 3. If for instance the length of the ram bar 3 is e.g. 2.5 to 4.2 m, two hydraulic cylinders are needed, and if the length is greater than this, two or more cylinders are needed.

The folding press further comprises a many-hinged manipulation arm 7 for grasping the piece of sheet material to be folded, introducing it between the first and/or second pair of folding blades in predetermined manner so that the manipulation arm 7 serves both the first and the second pair of folding blades. In FIG. 1 the manipulation arm has been detached from its stand, while the manipulation arm can be seen in FIGS. 2 ad 3. It is thus understood that the manipulation arm 7 comprises a stand 8, relative to which the manipulation arm 7 has been rotatably carried, and the stand 8 is centrally affixed to the ram beam 3. The manipulation arm 7 is in this case an industrial robot, comprising a robot arm 9 supported by a stand 8 and comprising consecutive arms 10,11,12 hinged to each other and a clamping member 13 for grasping the piece of sheet material. The number of freedoms of the robot 7, i.e., the number of its axles may, dependent on the state of advancement of the control, be such as is desired, advantageously not less than six, but it may for instance be unlimited employed is a robot provided with a so-called serpentine robot arm.

The folding press further comprises a tool storage 14, where various ram blades and couterblades $5^1$,$5^2$; $6^1$,$6^2$ can be kept ready to be exchanged and affixed to the ram and fixed beams. The tool storages 14 have been schematically depicted in FIG. 1 only, not in any other figure. The tool storages may be, as in the example of FIG. 1, revolving tool magazines which have been accommodated in the frame 1 on top of the folding press and which contain thrust blades and counterblades 5,$5^1$,$5^2$; 6,$6^1$,$6^2$ stored in substantially parallel position in relation to their working position, or in this case the vertical position. The tool storages 14 are, as shown in FIG. 1, arranged to be within reach of the manipulation arm 7 so that the ram blades and counterblades $5^1$,$5^2$; $6^1$,$6^1$ be changed with the and of the manipulation arm 7. In the example of FIG. 1 there are two tool storages 14, that is one for each pair of blades above each pair of blades, so that the robot can be caused to drop the blades directly from the magazine down into the blade fixing groove. If the blades are of the type which is assembled of mutually identical or different bits, such blade bits can be dropped down into their fixing grooves consecutively according to the so-called pearl string principle. The blade fixing groove and the corresponding groove or its like in the tool magazine are brought into register so that the fixing groove on the beam (on the fixed or ram beam) in a way continues into the tool magazine and one merely rotates into position from the tool magazine such a proper extension which holds the required blade and one lets the blade drop into the blade fixing groove. Blades can be selected from the magazine for mounting both on the ram beam and on the fixed beam. The frame 1 comprises guide members 16, along which the tool magazine 14 can be removed out of the vicinity of the pairs of blades from the working area to a piece where, for instance, the tool magazine will not interfere with removal of the piece of sheet material from between the blades and away past their top ends.

In FIG. 5 is depicted a folding press comprising three fixed beam $2^1$,$2^2$,$2^1$ and two ram beams 3. The ram beams 3 have been disposed alternatingly between the pairs of fixed beams $2^1$,$2^2$ and in one line with them. A folding press of this type can be formed by assembling in one frame two folding presses as in FIG. 1 and by affixing counterblades on both vertical sides of the centremost fixed beam $2^2$. The folding press comprises two industrial robots 7, each one arranged to serve two pairs of folding blades $5^1$,$6^1$; $5^2$,$6^2$. Furthermore the robots 7 are advantageously arranged to transport the piece of sheet material to each other and also to shake hands on software level so that when one robot takes hold of the piece of sheet material on the other side and the first robot releases its hold of the piece of sheet material, the location data of the piece of sheet material is preserved all the time and good accuracy is maintained. The machine may in this way operate as a versatile folding press line.

The invention is not exclusively delimited to concern the embodiment examples presented in the foregoing: numerous modifications are feasible within the scope of the inventive idea defined by the claims.

I claim:

1. A folding press for folding a sheet of material comprising:

a frame;

at least two fixed beams fixedly connected to said frame, said frame beams comprising a first and second fixed beam;

at least two counterblades, each counterblade connected to one of said fixed beams;

a movable ram beam supported by said frame and disposed between said fixed beams;

a first and second thrust blade connected on parallel margins of said ram beam;

a force member producing a bidirectional working stroke of said ram beam optionally toward said first and second fixed beams, said counterblades and said thrust blades are substantially vertical, said thrust blades being disposed on both parallel vertical margins of said ram beam and said counterblades being similarly disposed on the vertical margins of said fixed beams, said ram beam is movable substantially horizontally and said force member produces a horizontal working stroke of said ram beam; and a manipulation arm serving said first and second counterblades and said first and second thrust blades, wherein said first counterblades and said first thrust blade form a first folding pair and said second counterblade and said second thrust blade form a second folding pair, said manipulation arm is adapted for grasping said sheet of material and introducing said sheet of material to said first folding pair and to said second folding pair, said sheet of material being received between said first counterblade and said first thrust of said first folding pair and between said second counterblade and said second thrust blade of said second folding pair.

2. The folding press according to claim 1 wherein said manipulation arm comprises a stand, the manipulation arm being rotatable relative to said stand, and said stand is connected to said ram beam.

3. The folding press of claim 2 wherein said stand is connected centrally to said ram beam.

4. The folding press according to claim 1 wherein said manipulation arm is an industrial robot comprising a stand, a robot arm formed of consecutive arms hinged to each other and a clamping member for grasping the piece of sheet material.

5. The folding press according to claim 1 further comprising:

a tool storage for storing said thrust blades and counterblades, wherein said tool storage is disposed within reach of said manipulation arm so that said thrust blades and said counterblades are exchangeable by the aid of the manipulation arm.

6. The folding press according to claim 5 wherein said tool storage is a tool magazine positioned on top of said folding press, said tool magazine holding said thrust blades and said counterblades in a substantially parallel position relative to their working position.

7. The folding press according to claim 1 further comprising a plurality of said ram beams disposed between pairs of fixed beams and arranged in line with them;

each one of said manipulation arms arranged to serve two pairs of said folding blades and to transport said folding blades to the pieces to be folded.

8. A folding press for folding a sheet of material comprising:

a frame;

at least two fixed beams fixedly connected to said frame, said frame beams comprising a first and second fixed beam;

at least two counterblades, each counterblade connected to one of said fixed beams;

a movable ram beam supported by said frame and disposed between said fixed beams;

a first and second thrust blade connected on parallel margins of said ram beam;

a force member producing a bidirectional working stroke of said ram beam optionally toward said first and second fixed beams, said counterblades and said thrust blades are substantially vertical, said thrust blades being disposed on both parallel vertical margins of said ram beam and said counterblades being similarly disposed on the vertical margins of said fixed beams, said ram beam is movable substantially horizontally and said force member produces a horizontal working stroke of said ram beam;

a manipulation arm serving said first and second counterblades and said first and second thrust blades;

said first counterblades and said first thrust blade form a first folding pair and said second counterblade and said second thrust blade form a second folding pair, said manipulation arm is adapted for grasping said sheet of material and introducing said sheet of material to said first folding pair and to said second folding pair, said sheet of material being received between said first counterblade and said first thrust of said first folding pair and between said second counterblade and said second thrust blade of said second folding pair; and guides affixed to said ram beam in parallel relation to said folding blades, wherein said manipulation arm is movable along said guides into various positions relative to said ram beams.

9. A folding press for folding a sheet of material comprising:

a frame;

at least two fixed beams fixedly connected to said frame, said frame beams comprising a first and second fixed beam;

at least two counterblades, each counterblade connected to one of said fixed beams;

a movable ram beam supported by said frame and disposed between said fixed beams;

a first and second thrust blade connected on parallel margins of said ram beam;

a force member producing a bidirectional working stroke of said ram beam optionally toward said first and second fixed beams, said counterblades and said thrust blades are substantially vertical, said thrust blades being disposed on both parallel vertical margins of said ram beam and said counterblades being similarly disposed on the vertical margins of said fixed beams, said ram beam is movable substantially horizontally and said force member produces a horizontal working stroke of said ram beam;

a manipulation arm serving said first and second counterblades and said first and second thrust blades;

wherein said first counterblades and said first thrust blade form a first folding pair and said second counterblade and said second thrust blade form a second folding pair, said manipulation arm is adapted for grasping said sheet of material and introducing said sheet of material to said first folding pair and to said second folding pair, said sheet of material being received between said first counterblade and said first thrust of said first folding pair and between said second counterblade and said second thrust blade of said second folding pair;

a tool storage for storing said thrust blades and counterblades is disposed within reach of said manipulation arm so that said thrust blades and said counterblades are exchangeable by the aid of the manipulation arm, said tool storage is a tool magazine positioned on top of said folding press, said tool magazine holding said thrust blades and said counterblades in a substantially parallel position relative to their working position, wherein said tool magazine revolves.

10. A folding press for folding a sheet of material comprising:

a frame;

at least two fixed beams fixedly connected to said frame, said frame beams comprising a first and second fixed beam;

at least two counterblades, each counterblade connected to one of said fixed beams;

a movable ram beam supported by said frame and disposed between said fixed beams;

a first and second thrust blade connected on parallel margins of said ram beam;

a force member producing a bidirectional working stroke of said ram beam optionally toward said first and second fixed beams, said counterblades and said thrust blades are substantially vertical, said thrust blades being disposed on both parallel vertical margins of said ram beam and said counterblades being similarly disposed on the vertical margins of said fixed beams, said ram beam is movable substantially horizontally and said force member produces a horizontal working stroke of said ram beam; and a manipulation arm serving said first and second counterblades and said first and second thrust blades;

said first counterblades and said first thrust blade form a first folding pair and said second counterblade and said second thrust blade form a second folding pair, said manipulation arm is adapted for grasping said sheet of material and introducing said sheet of material to said first folding pair and to said second folding pair, said sheet of material being received between said first counterblade and said first thrust of said first folding pair and between said second counterblade and said second thrust blade of said second folding pair; and a plurality of manipulation arms, each one of said manipulation arms arranged to serve two pairs of said folding blades and to transport said folding blades to the material to be folded, wherein the number of said manipulation arms is equivalent to the number of ram beams.

11. A folding press for folding a sheet of material comprising:

a frame;

at least two fixed beams fixedly connected to said frame, said frame beams comprising a first and second fixed beam;

at least two counterblades, each counterblade connected to one of said fixed beams;

a movable ram beam supported by said frame and disposed between said fixed beams;

a first and second thrust blade connected on parallel margins of said ram beam;

a force member producing a bidirectional working stroke of said ram beam optionally toward said first and second fixed beams, said counterblades and said thrust blades are substantially horizontal, said thrust blades being disposed on both parallel horizontal margins of said ram beam and said counterblades being similarly disposed on the horizontal margins of said fixed beams, said ram beam is movable substantially horizontally and said force member produces a horizontal working stroke of said ram beam;

a manipulation arm serving said first and second counterblades and said first and second thrust blades;

said first counterblades and said first thrust blade form a first folding pair and said second counterblade and said second thrust blade form a second folding pair, said manipulation arm is adapted for grasping said sheet of material and introducing said sheet of material to said first folding pair and to said second folding pair, said sheet of material being received between said first counterblade and said first thrust of said first folding pair and between said second counterblade and said second thrust blade of said second folding pair;

wherein said folding press is disposed in a substantially horizontal position, said ram beams, said fixed beams and said folding blades are disposed substantially in a horizontal plane and said sheet of material can be introduced between said folding blades in a substantially vertical position.

* * * * *